US012575649B2

(12) United States Patent
Reese et al.

(10) Patent No.: US 12,575,649 B2
(45) Date of Patent: Mar. 17, 2026

(54) APPAREL FASTENER HAVING INTEGRATED ADJUSTABLE TENSIONER

(71) Applicant: OPO TECHNOLOGY LLC, Colorado Springs, CO (US)

(72) Inventors: Robert R Reese, Colorado Sorings, CO (US); Weyman Weems, Littleton, CO (US)

( * ) Notice: Subject to any disclaimer, the term of this patent is extended or adjusted under 35 U.S.C. 154(b) by 0 days.

(21) Appl. No.: 18/122,100

(22) Filed: Mar. 15, 2023

(65) Prior Publication Data

US 2024/0074543 A1 Mar. 7, 2024

Related U.S. Application Data

(60) Provisional application No. 63/320,205, filed on Mar. 15, 2022.

(51) Int. Cl.
*A44B 1/18* (2006.01)
*A41F 1/00* (2006.01)

(52) U.S. Cl.
CPC ..... *A44B 1/18* (2013.01); *A41F 1/008* (2013.01)

(58) Field of Classification Search
CPC ..... A44B 1/18; A41F 1/008; Y10T 74/1967; Y10T 24/2187; Y10T 24/1928; Y10T 24/3604; Y10T 24/45042; A61F 9/02; A61F 9/025
USPC ..... 2/418, 235, 237, 265
See application file for complete search history.

(56) References Cited

U.S. PATENT DOCUMENTS 1,475,065 A * 11/1923 Gilbertson ..... B60C 27/10 24/68 TT
3,047,876 A * 8/1962 Malcom, Jr. ..... A42B 3/145 2/9
3,214,809 A * 11/1965 Zahnor ..... A61F 9/06 2/418
3,325,824 A * 6/1967 Donegan ..... A61F 9/06 24/68 B
4,090,691 A * 5/1978 Bingaman ..... F16G 11/12 24/71.1
5,357,654 A * 10/1994 Hsing-Chi ..... A63B 33/002 2/418
6,179,176 B1 * 1/2001 Saggese ..... A45F 3/04 190/18 R
6,708,376 B1 * 3/2004 Landry ..... A42B 3/145 2/418
7,000,262 B2 * 2/2006 Bielefeld ..... A42B 3/145 2/418
7,222,374 B2 * 5/2007 Musal ..... A42B 3/066 24/274 WB
7,707,695 B2 * 5/2010 Dubois ..... A42B 3/145 2/418
8,424,168 B2 4/2013 Soderberg et al.
8,468,657 B2 6/2013 Soderberg et al.
8,516,662 B2 8/2013 Soderberg et al.
2009/0056487 A1 * 3/2009 Chiu ..... F16B 2/08 74/422
2009/0211385 A1 * 8/2009 Fiquepron ..... A42B 3/145 74/422

(Continued)

*Primary Examiner* — Jason W San
*Assistant Examiner* — Rowland Do
(74) *Attorney, Agent, or Firm* — GottardoLaw LLC

(57) ABSTRACT

An apparatus and method for fastening apparel with a fastener having an integrated and adjustable tensioner that facilitates a precise fitment of the apparel when worn.

9 Claims, 10 Drawing Sheets

(56) References Cited

U.S. PATENT DOCUMENTS

| | | | | |
|---|---|---|---|---|
| 2010/0170068 | A1* | 7/2010 | Musal | A42B 3/145<br>24/68 D |
| 2018/0263322 | A1* | 9/2018 | Martin | A41D 1/06 |
| 2020/0093227 | A1* | 3/2020 | Martin | A41F 9/025 |

* cited by examiner

APPAREL FASTENER HAVING INTEGRATED ADJUSTABLE TENSIONER

CROSS REFERENCE TO RELATED APPLICATIONS

This application claims the filing date of U.S. Provisional Patent Application Ser. No. 63/320,205 filed on Mar. 15, 2022, which is fully incorporated herein.

TECHNICAL FIELD OF THE INVENTION

This invention relates generally to apparel fastening devices. More specifically, the invention relates to an apparatus and method for fastening apparel with a fastener having an integrated and adjustable tensioner that facilitates a precise fitment of the apparel when worn.

BACKGROUND OF THE INVENTION

Apparel is worn everyday by billions of individuals across the globe. However, despite great variations existing in anatomical size and proportion between these countless individuals, apparel designers and manufacturers, in the interests of cost savings and efficiency, design and produce clothing having only standardized size dimensions; often resulting in the apparel not providing a custom fit for a given individual. For example, the majority of bottoms (i.e., pants, shorts, skirts, etc.) within the marketplace are manufactured having waist sizes falling on 2 inch increments (i.e., 32, 34, 36 in., etc) ill-defined to fit individuals having a waist size not falling on such an increment.

Thus, if a given individual has a 33 inch waistline, that individual is generally both forced to buy a bottom having a waist size falling on the next largest increment, namely, falling on the 34 inch dimension, and thereafter adjust the waist size downwardly by 1 inch via the use of a belt or employment of a tailor. However, numerous disadvantages exist in having to use a belt or employ a tailor to attain a custom fit. Belts present an added cost in having to purchase an accessory in addition to the apparel itself. Also, apparel, for aesthetic reasons, is often designed to not accommodate the use of a belt, i.e., designed to omit belt loops as unsightly or unfashionable. Furthermore, common belts are themselves designed to provide an incremental fitment, i.e., with belt holes falling at incremental locations that may not coincide with the precise measurement of the wearer's waist. Although tailors can indeed alter apparel to custom fit a wearer, the underlying alteration often results in both a destructive and irreversible modification of the apparel itself, further inconveniently requiring a wearer to visit the tailor and undergo physical measurement. The employment of a tailor is often costly as well.

The lack of a custom fit of apparel for a wearer is exacerbated for children undergoing growth spurts. Parents must therefore contend with buying apparel for children who will likely outgrow it over short time durations. Again, because such apparel is not adjustable to custom-fit children during periods of growth, parents often buy oversized clothing that children "can grow into," thus again resulting in a ill-fit between the apparel and wearer.

The lack of a custom fit is also exacerbated by certain apparel designs driven by fashion trends. For example, the rising popularity of low-rise waistbands for bottoms, generally worn below the hips, presents challenges in maintaining such bottoms in the desired position on the wearer. Simply put, if the bottom has a waist dimension increment larger than that the waistline dimension of the wearer, the bottoms will fall down unless the wearer utilizes bottoms that are uncomfortably too small (i.e., having an waist dimension increment smaller than the wearer's waistline dimension) or uses the aforementioned and often undesirable belt. Also, the average person undergoes weight fluctuations that can result in changes in the waist dimensions of 1 to 2 inches during a given year. Fixed garment sizes do not accommodate for such fluctuations.

Although apparel designers have utilized "stretch fabrication materials" (i.e., elastomeric materials) within apparel in an attempt to provide custom-fit waistlines for the wearer, such materials are prone to degradation over time, i.e., via a laundering or dry cleaning of the apparel, and thus lose their desired elastic capabilities. Elastomeric materials are also prone to fluctuations in their functional abilities due to surrounding temperatures, with warm temperatures often resulting in an expansion of the materials and an associated loss of desired retraction capability. Also, while stretch fabrications provide enhanced comfort, they are designed to expand with the wearer, but not contract; causing a loose fitting garment. Furthermore, the weight of individuals fluctuates daily, and stretch fabrics simply do not contract to allow for these fluctuations Thus, what is needed is an apparatus and method for fastening apparel such that apparel designed and manufactured having standardized size dimensions will nonetheless custom-fit the wearer without the need for belts or a tailor. The invention should further accommodate the custom-fit adjustment of children undergoing growth changes, as well as of apparel having design requirements dictated by fashion trends. The invention should also obviate the functional deficiencies associated with prior art, elastomeric materials. The present invention satisfies these foregoing disadvantages and presents other advantages over the prior art as well.

SUMMARY OF THE INVENTION

This invention relates generally to apparel fastening devices. More specifically, the invention relates to an apparatus and method for fastening apparel with a fastener having an integrated and adjustable tensioner that facilitates a precise fitment of the apparel when worn. In a first embodiment, fastener for apparel comprises a housing defining at least one guide-way, at least one rack connectible with the apparel and translationally associated with the at least one guide-way, with the rack defining a linear arrangement of teeth, as well as a distal end connectable with the apparel. A pinion assembly defines a circular arrangement of teeth configured for operable engagement with the linear arrangement of teeth of the rack. The circular arrangement of teeth is operably biased to a locked position from a rotatable position, with the pinion assembly further defining an outer end configured for insertional engagement with an orifice defined in the apparel.

The pinion assembly further defines a shaft affixed to the housing and terminating outwardly of the housing at the outer end of the assembly, with the circular arrangement of teeth extending radially from a disc having an axial bore defined there-through. The shaft extends through the axial bore of the disc, with the disc rotatable about the shaft and laterally biased to non-rotatably engage the outer end of the assembly to define the locked position. The non-rotatable engagement of the disc to the outer end comprises a mating obstruction defined there-between and the bias of the disc to the non-rotatable engagement comprises a spring forcibly contacting the disc.

A grip is located between the disc and outer end and defining the mating obstruction there-between, with the grip configured to transmit a lateral force to the disc to overcome the bias of the spring and also configured to transmit a rotational force to the disc to rotate the disc when not in the locked position. The grip is further configured for insertional engagement with the orifice. The spring comprises a plurality of inwardly directed tabs defined in the housing about the shaft, the tabs configured for resilient engagement with an inner face of the disc. In a second embodiment, fastener for apparel comprises a housing defining at least one guide-way, at least one rack connectible with the apparel and translationally associated with the at least one guide-way, with the rack defining a linear arrangement of teeth, as well as a distal end connectable with the apparel. A pinion assembly defines a circular arrangement of teeth configured for operable engagement with the linear arrangement of teeth of the rack. The circular arrangement of teeth is operably biased to a locked position from a rotatable position, with the pinion assembly further defining an outer end configured for insertional engagement with an orifice defined in the apparel.

The pinion assembly further defines a shaft affixed to the housing and terminating outwardly of the housing at the outer end of the assembly, with the circular arrangement of teeth extending radially from a pedestal having an axial bore defined there-through. The shaft extends through the axial bore of the pedestal, with the pedestal rotatable about the shaft and laterally biased to non-rotatably engage the outer end of the assembly to define the locked position.

The non-rotatable engagement of the pedestal to the outer end comprises a mating obstruction defined there-between and the bias of the pedestal to the non-rotatable engagement comprises a spring forcibly contacting the pedestal. A grip is defined on the pedestal proximal to the outer end and defines the mating obstruction there-between. The grip is configured to transmit a lateral force to the pedestal to overcome the bias of the spring, and is also configured to transmit a rotational force to the pedestal to rotate the pedestal when not in the locked position, the pedestal further configured for insertional engagement with the orifice. The spring comprises a coil or circular leaf spring located about the shaft between the pedestal and the housing.

DESCRIPTION OF THE EMBODIMENTS

Figure 1:
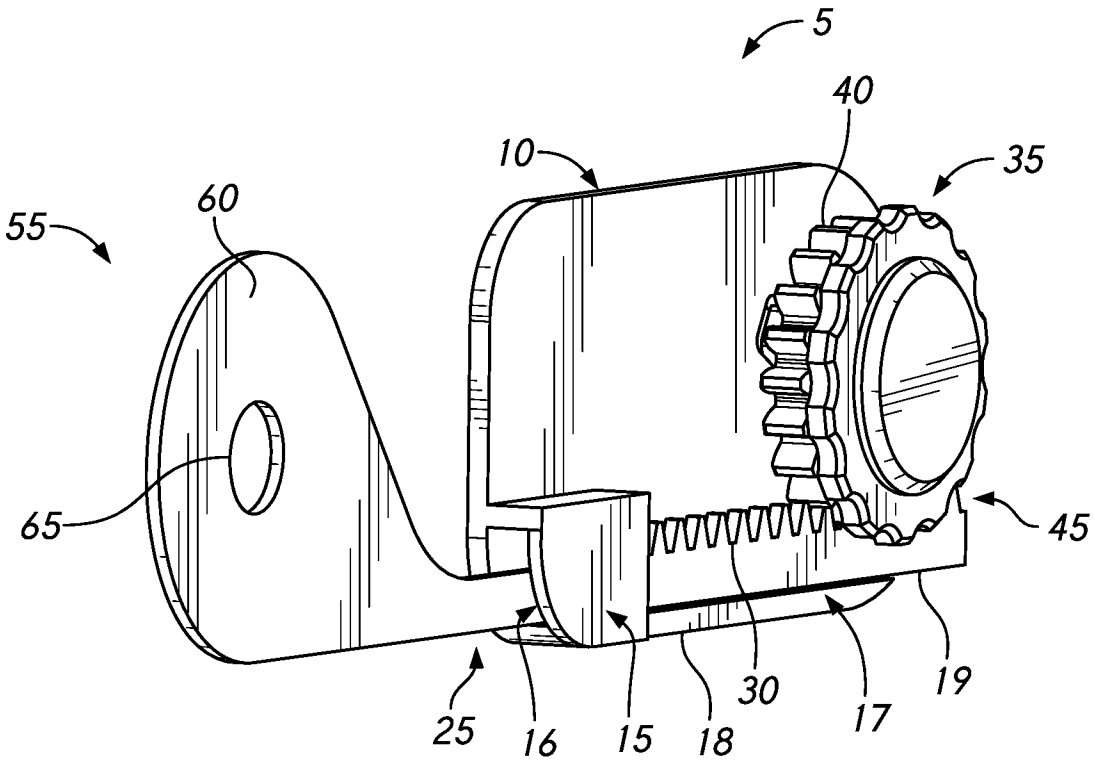
FIG. 1 is a perspective view of a first embodiment of the fastener.

This invention relates generally to apparel fastening devices. More specifically, the invention relates to an apparatus and method for fastening apparel with a fastener having an integrated and adjustable tensioner that facilitates a precise fitment of the apparel when worn. In a first embodiment illustrated in FIGS. 1, 2 and 3, the fastener 5 comprises a planar housing 10 defining at least one guide-way 15. The planar housing 10 is sheet-like in structure to allow for a non-interfering and operable relation of the fastener 5 with the sheet-form material typically comprising apparel 20. At least one rack 25 is connectible with the apparel 20 and translationally associated with the at least one guide-way 15, with the at least one rack defining a linear arrangement of teeth 30. The guide-way preferably comprises at least one slot 16 defined in the housing 10 and a shelf 17 defined along the housing's bottom edge 18. The shelf 17 is configured to support the at least one 25 rack along its bottom surface 19 while the at least slot 16 is configured to both accept a male insertion of the rack there-through and maintain the rack on the shelf.

A pinion assembly 35 defining a circular arrangement of teeth 40 is configured for meshing engagement with the linear arrangement of teeth 30 of the at least one rack 25. The circular arrangement of teeth 40 is operably biased to a locked position "A" from a rotatable position "B" (FIG. 3), such that the rack 25 is prevented from translating in relation to the housing 10 when the circular arrangement of teeth are in the locked position and allowed to translate when the circular arrangement of teeth is in the rotatable position. The pinion assembly 35 further defines an outer end 45 configured for insertional engagement with an orifice 50 (FIG. 2) defined in the apparel 20.

A distal end 55 of the at least one rack 25 is configured for fixable engagement with the material of the apparel 20. In the embodiment illustrated in FIGS. 1 and 2, the distal end 55 of the at least one rack 25 defines a planar flange 60 having a void 65 defined there-through. The planar flange 60 is sheet-like in structure to allow for a non-interfering and operable relation of the rack 25 with the sheet-form material typically comprising apparel 20. In this embodiment, the void 65 defines a through bore such that a rivet or similar fastener (not shown) may be inserted through the rack's void 65 and adjacent material of the apparel 20 to securely fasten the rack to the apparel. In other embodiments, however, the flange 60 of the at least one rack 25 may be sewn to adjacent material of the apparel 20 as well.

Figure 2:
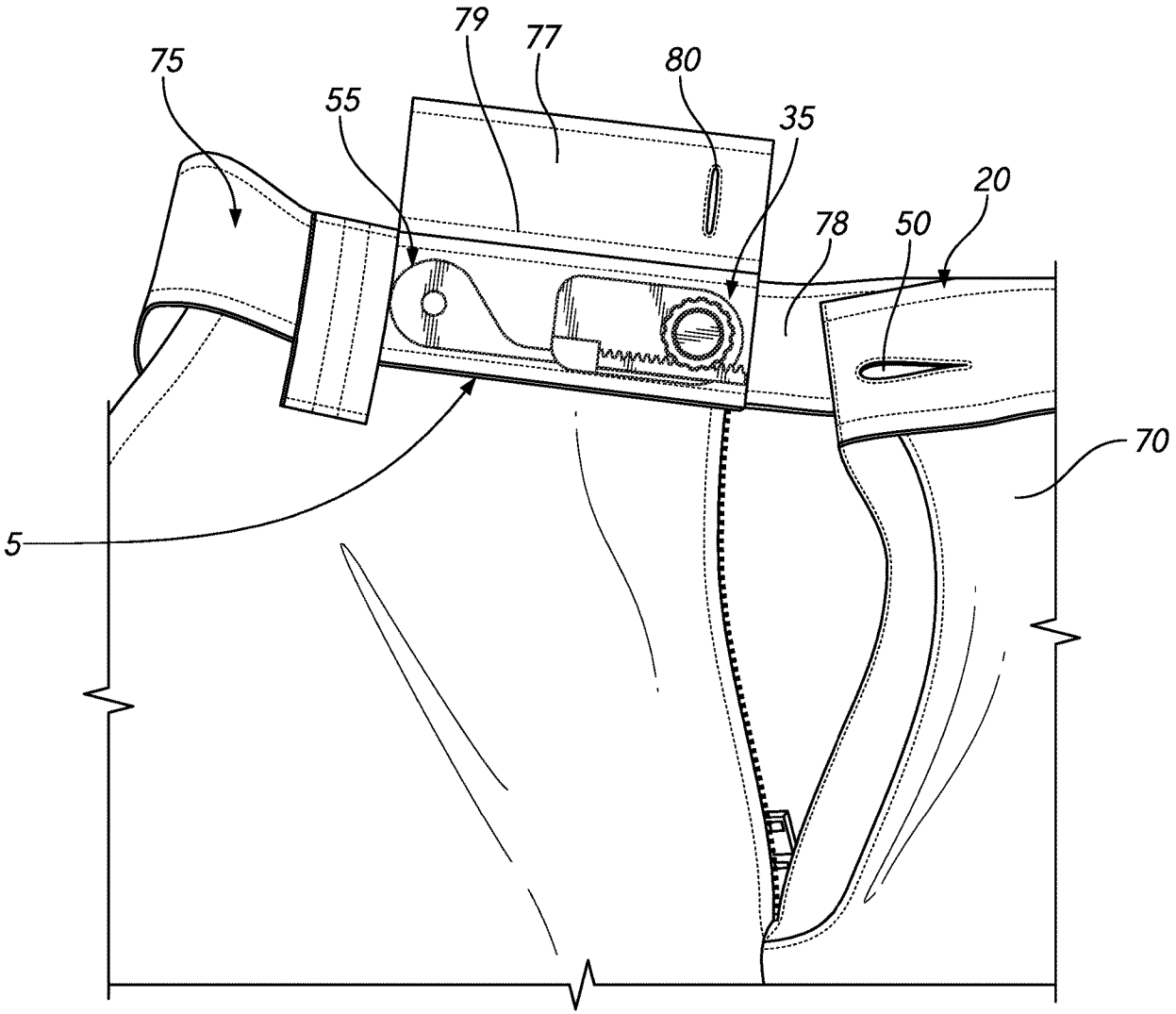
FIG. 2 is a view of the fastener of FIG. 1 utilized with apparel.

As illustrated in FIG. 2, the apparel 20, for example, comprises a pair of pants 70, with the fastener 5 incorporated into the pants' waistline 75 to replace a standard button (not shown). As is typical within the industry, the pants 70 includes a hollow loop of material at its waistline to create at least two "front-to-back" layers 77 and 78 of material encircling the waistline to increase its strength and durability. To more clearly illustrate the placement of the fastener 5 in relation to the pants 70, FIG. 2 illustrates a rectangular section of the front material 77 lifted upwardly and away from the rear material 78 along a seam 79 such that the apparatus is proximal to the rear material and the front material is folded downwardly along the seam to a location proximal to and in front of the apparatus. The fastener's housing 10, at least one guide-way 15 and at least one rack 25 are together sewn into the pant's waistline 75, preferably between the front and back material layers 77 and 78, with the fastener's pinion assembly 35 protruding outwardly through an opening 80, defined through the front layer, to function as the standard button for insertion through the apparel's orifice 50.

The rack 25 and housing 10 are preferably comprised of flexible, lightweight, and corrosion-free sheet-form materials of high durability. The flexible and lightweight traits of the material allow the components to assume the bodily contours of a wearer of the apparel utilizing the fastener, all while adding negligible weight to the apparel itself. The material of the rack and/or housing may be produced or manufactured to possess a predetermined curvature to further ensure a proper of the apparatus to the contours of a body. The durable and corrosion free traits of the material allows for the regular wear and laundering of the apparel utilizing the fastener without risk of the fastener staining the apparel or otherwise breaking. As such, at least the housing and rack preferably comprise sheet-form plastic or aluminum. The thickness of the sheet-form material comprising the housing 10 is between about 0.039 and 0.393 inches, preferably between about 0.079 and 0.197 inches, and optimally about 0.177 inches. Similarly, the thickness of the sheet-form material comprising the rack 25 is between about 0.016 and 0.393 inches, preferably between about 0.023 and 0.197 inches, and optimally about 0.393 inches. The sheet-form materials for the housing 10 and/or rack 25 may be stamped from a sheet-form material source, made from an injection molded process, machined or manufactured by other means understood in the art.

Figure 3:
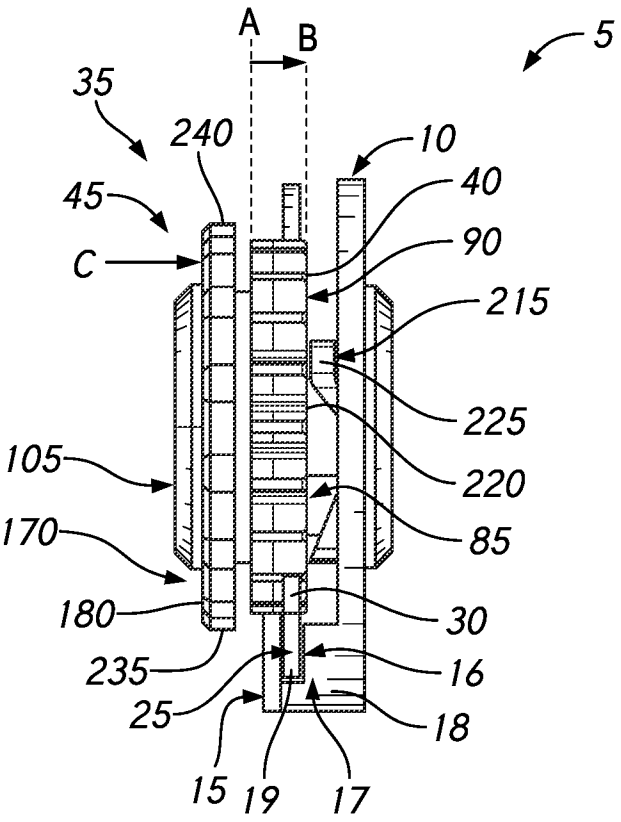
FIG. 3 is an elevation view of a proximal end of the fastener of FIG. 1.
Figure 4:
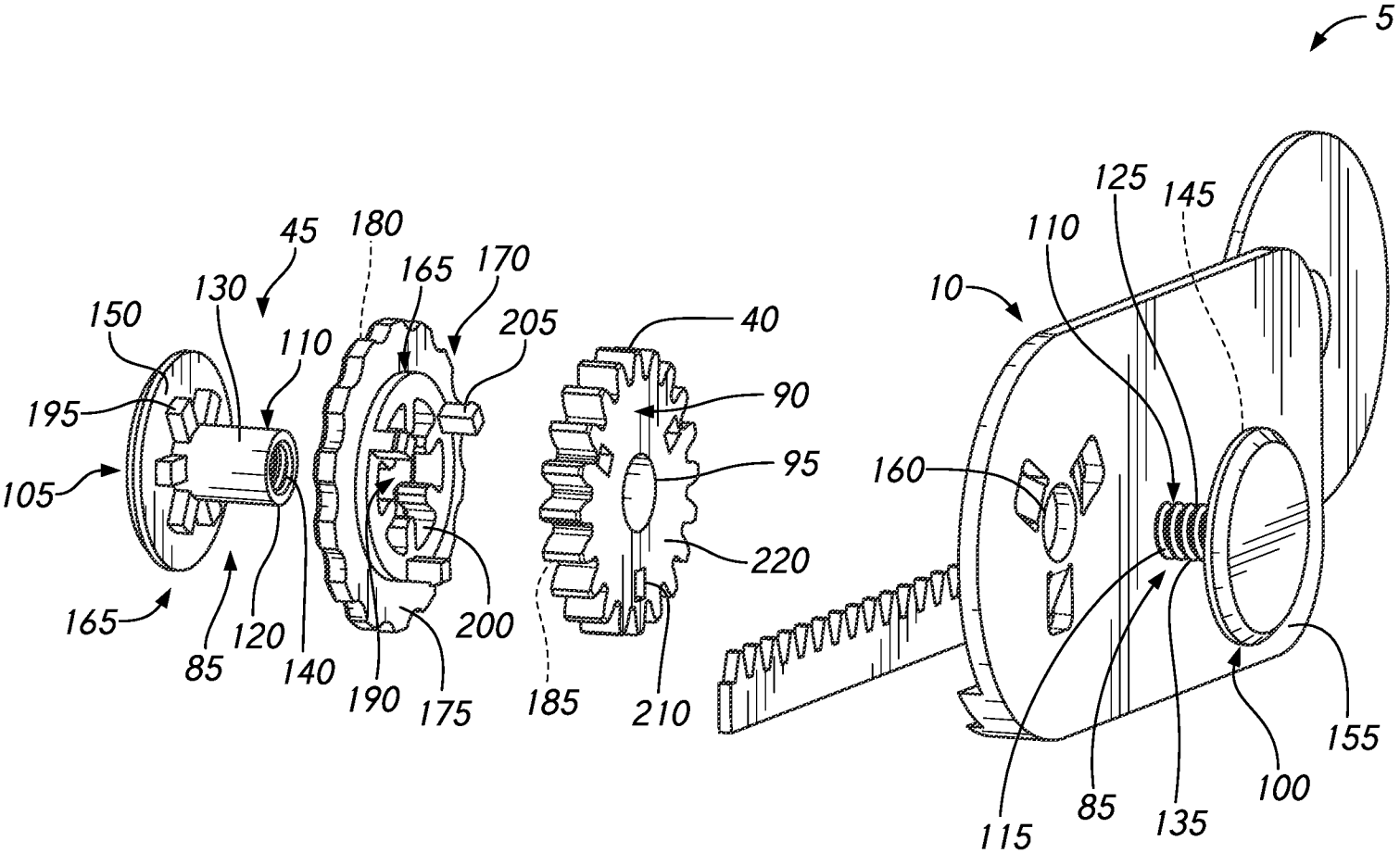
FIG. 4 is an exploded view of the fastener of FIG. 1 illustrating the details of a mating engagement within the pinion assembly.

Referring now to FIGS. 3 and 4, the pinion assembly 35 further defines a shaft 85 affixed to the housing 10 and terminating outwardly of the housing at the pinion assembly's outer end 45. The circular arrangement of teeth 40 extends radially from a disc 90 having an axial bore 95 defined there-through. The shaft 85 extends through the axial bore 95 of the disc 90, which is configured for both rotational and lateral movement about the shaft 85. The disc 90 is rotatable about the shaft 85 and laterally biased to non-rotatably engage the outer end 45 of the pinion assembly to define the aforementioned locked position A.

As best illustrated in FIG. 4, the shaft 85 comprises opposing column ends 100 and 105 defined opposite of one another to define a central column 110, with each column end approximating the shape of a rivet head. The opposing column ends 100 and 105, in turn, each define inner mating ends 115 and 120, and associated column portions 125 and 130 which, when in mating relation with one another, define the central column 110. The mating ends 115 and 120 thus preferably define respective, male and female threaded components 135 and 140 that threadedly engage one another to define the column 110. Although a threaded connection is described and illustrated herein at mating ends 115 and 120, it is understood that other connections may be utilized as well, to include pinned male-female connections, press-fit and other connections understood in the art as preventing a rotation and translation of components relative to one another.

Referring again to FIG. 4, the opposing column ends 100 and 105 each define a planar inner face 145 and 150. Planar inner face 145 is affixed to a planar rear surface 155 of the housing 10 such that column portion 125 extends forwardly through a hole 160 defined through the housing for threaded engagement with opposing column portion 130. Such affixation may comprise spot welding, thermal bonding, brazing, adhesive bonding or other bonding methods understood in the art. The affixation of the inner face 145 of the column end 100 to the rear surface 155 of the housing 10 prevents the column end and associated portion 125 from rotating in relation to the housing and also from translating outwardly from the housing's rear surface 155. The threaded engagement of the opposing column portion 125 and end mating end 115 to opposing portion 130 thus similarly affixes them as well in relation to the housing 10.

The non-rotatable engagement of the disc 90 to the outer end 45 of the pinion assembly 35 preferably comprises a mating obstruction 165 defined there-between. More specifically, as illustrated herein, a grip 170 is located between the disc 90 and assembly's outer end 45 that defines the mating obstruction 165. The grip 170 thus defines inner and outer faces 175 and 180, with the grip outer face configured for mating engagement with the inner face 150 of column end 105, and the grip inner face 175 configured for fixable engagement with an outer face 185 of the disc 90. A grip bore 190 is defined between its inner and outer faces 180 and 185 and is configured for both rotational and lateral movement about the shaft 85.

Referring again to FIG. 4, a plurality of radial spokes 195 protrude from the inner face 150 of outer column end 105 for mating engagement with a plurality of radial recesses 200 defined in the grip outer face 180. The mating engagement of the spokes 195 with the recesses 200 prevents the grip 170 from rotating in relation to the outer end 45 of the pinion assembly 35, but nonetheless allows the grip to move laterally and inwardly from the end and along the shaft 85. As further illustrated in FIG. 4, a plurality of projections 205 protrude from the inner face 175 of grip 170 for mating engagement with a plurality of receivers 210 defined in the disc outer face 185. The mating engagement of the projections 205 with the receivers 210 prevents the grip 170 from both rotating in relation to the disc 90 and translating outwardly from the disc and along the shaft 85 as well. The components of the pinion assembly 35, together or independently, may be comprised of durable materials, to include aluminum, steel, plastics, combinations or other materials understood in the art as providing the desired durability.

Figure 5:
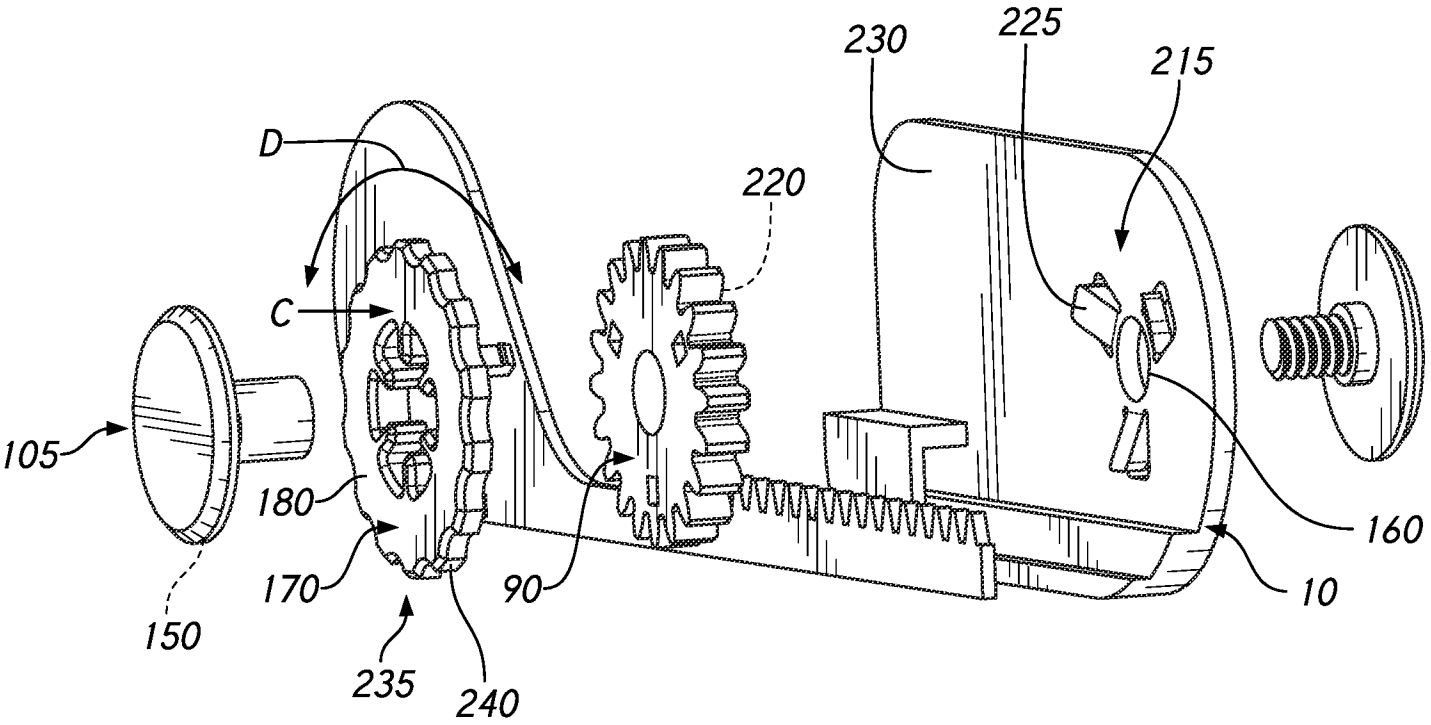
FIG. 5 is an exploded view of the spring of the housing along with the disc and grip of the pinion assembly of FIG. 1.

The lateral bias of the disc 90 and connected grip 170 along the shaft 85 to a non-rotatable engagement with the inner face 150 of the column end 105 comprises a spring 215 that forcibly contacts an inner face 220 of the disc 90. Referring to FIG. 5, in a preferred embodiment, the spring 215 comprises a plurality of forwardly directed tabs 225 defined in the housing 10 about housing's hole 160 and configured for resilient engagement with the inner face 220 of the disc 90. In other embodiments, however, a common coil spring (not shown) or circular leaf spring (FIGS. 9-10) may be located on the shaft 85 between an inner wall 230 of the housing 10 and the inner face 220 of the disc 90 to bias the disc and grip 170 to the non-rotatable engagement with the outer column end 105.

Referring again to FIGS. 3 and 5, the grip 170 is thus configured to transmit a lateral force "C" to the disc 90 to both overcome the bias of the spring 215 and move the disc laterally along the shaft 85 of the pinion assembly 35 to the rotatable position B from the locked position A, and also configured to transmit a rotational force "D" to the disc (when not in the locked position), to rotate the disc's circular arrangement of teeth 40 against the rack 25. More specifically, the lateral force C urges the disc's inner face 220 against the plurality of forwardly directed tabs 225 of the housing 10 housing such that the tabs are resiliently defected rearwardly towards the housing's inner wall 230.

During this movement, the teeth 40 of the disc 90 remain engaged with the at least one rack 25, but translate rearwardly in relation to the rack's teeth 30 and towards the housing's inner wall 230. During this rearward movement, the disc is translated rearwardly along the column 110 to disengage the disc's recesses 200 from the spokes 195 of the outer column end 105. With the spokes and recesses disengaged from one another, the grip and disc are now together rotatable about the column 110 via the application of rotatable force D (FIG. 5). Of course, during any rotation of the disc 90, the rack 25 will translate in relation to the housing 10, and apply a like translational force against the material of the apparel 20 affixed to the rack's planar flange 60.

To facilitate the transmission of both the lateral and rotational forces C and D to the disc 90, the grip 170 defines a diameter larger than that of both the disc and the column end 105 such that both the outer face 180 of the grip and an associated peripheral edge 235 are exposed beyond that of the column end to a facilitate tactile contact with the fingers and thumb of a user of the fastener 5. In a preferred embodiment, the peripheral edge 235 of the grip 170 is also textured to improve such tactile contact as well. For example, in the embodiments illustrated herein, the peripheral edge 235 of the grip 170 defines a plurality of truncated ridges 240. However other textures may suffice as well, to include cross-hatch, dimpled and other patterns understood in the art of increasing tactile friction. Nonetheless, despite the larger diameter of the grip 170, the diameter is nonetheless configured for insertional engagement with the standard orifice 50 defined in the apparel 20. Thus, the diameter of the grip is between about 0.375 and 2.0 inches, preferably between about 0.5 and 1.5 inches, and optimally about 0.875 inches.

Figure 6:
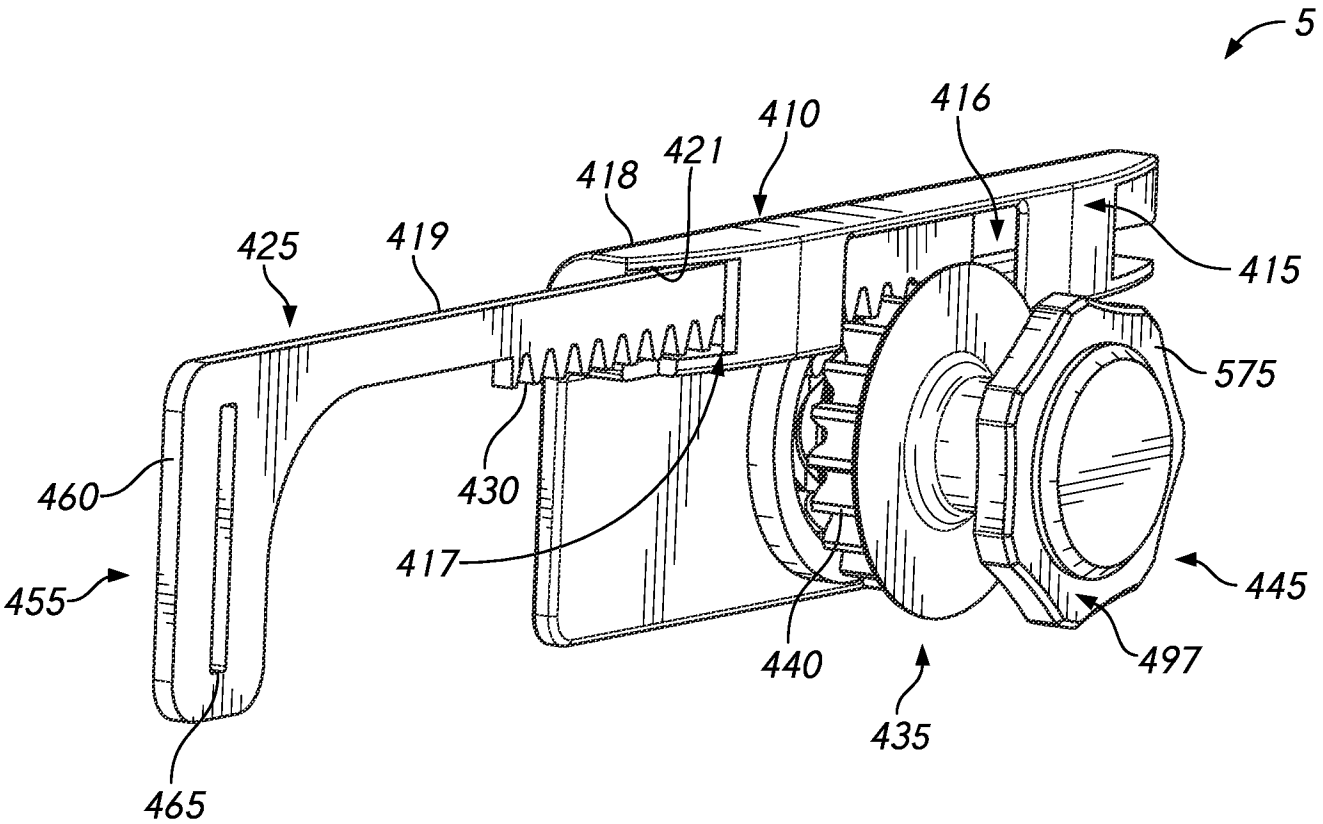
FIG. 6 is a perspective view of a second embodiment of the fastener.
Figure 7:
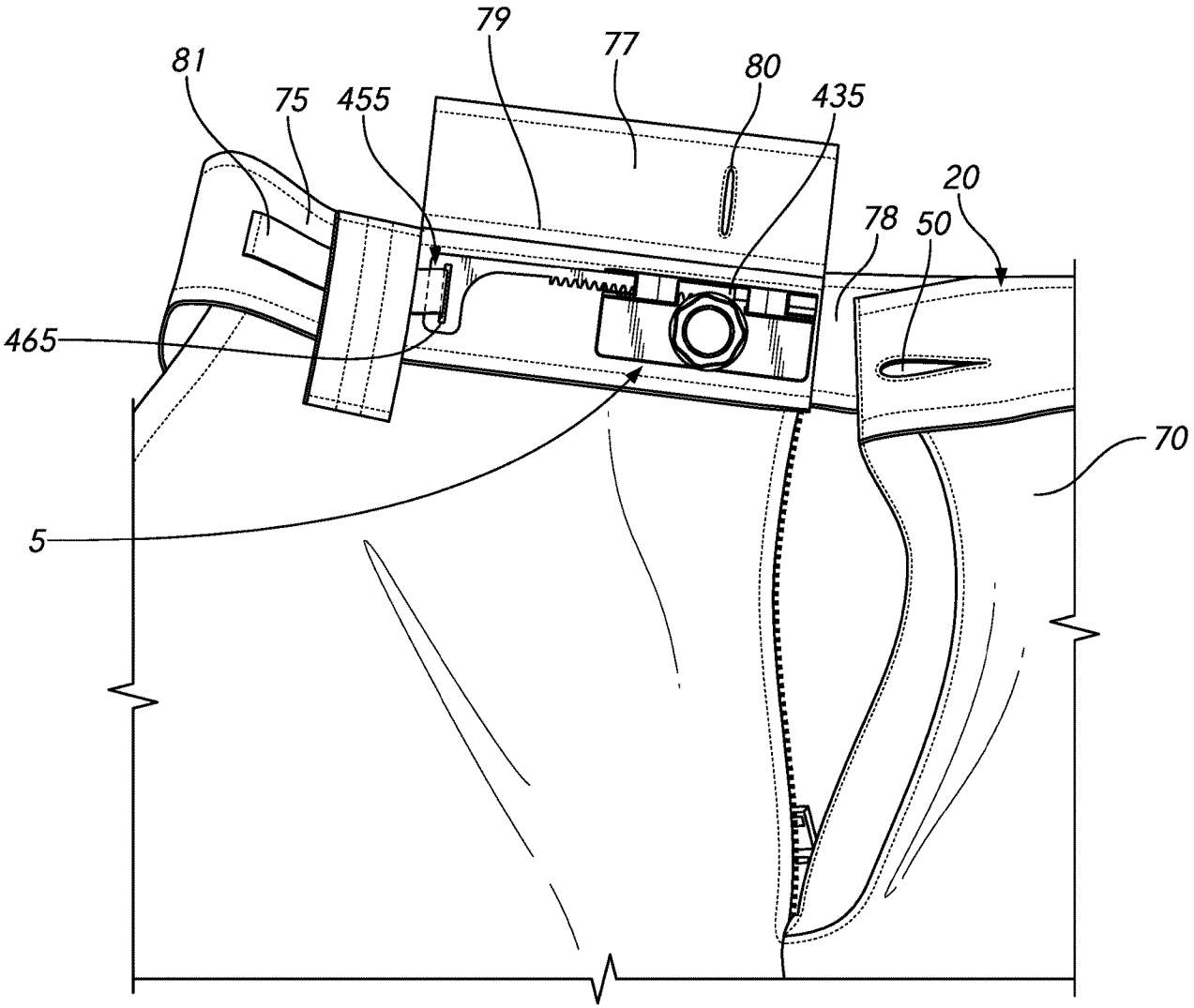
FIG. 7 is a view of the fastener of FIG. 6 utilized with apparel.
Figure 8:
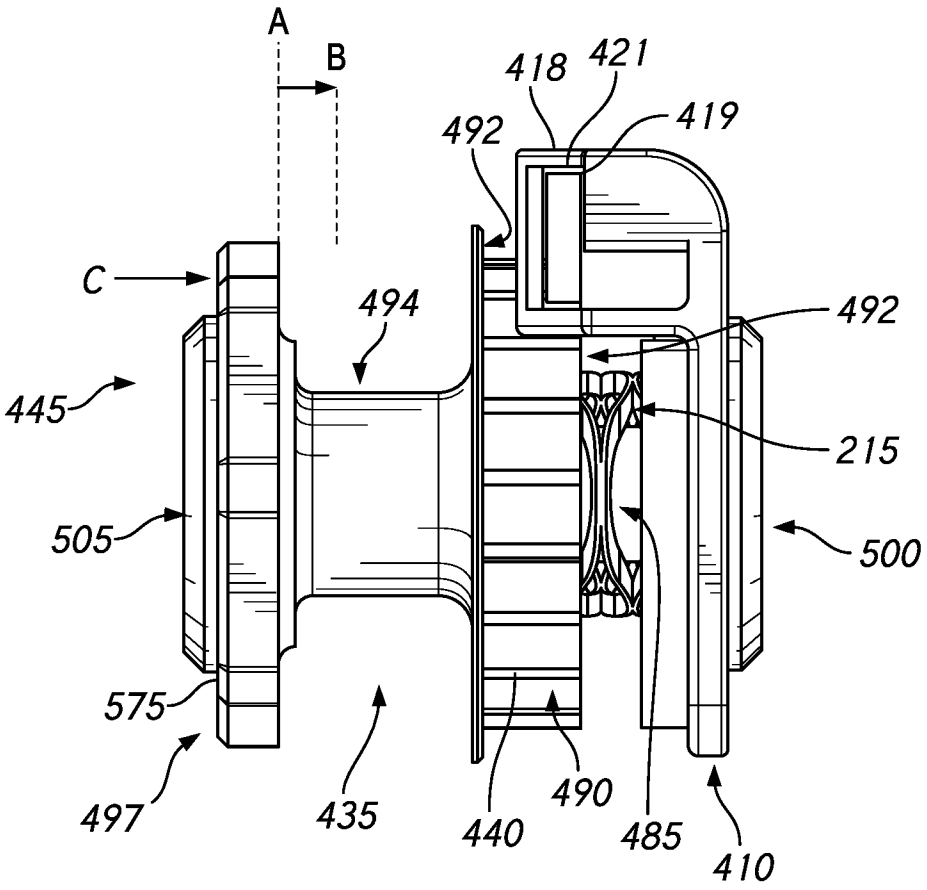
FIG. 8 is an elevation view of a proximal end of the fastener of FIG. 6.

In the second embodiment illustrated in FIGS. 6, 7 and 8, the fastener 5 again comprises a planar housing 410 defining at least one guide-way 415. The planar housing 410 is sheet-like in structure to allow for a non-interfering and operable relation of the fastener 5 with the sheet-form material typically comprising apparel 20. At least one rack 425 is connectible with the apparel 20 and translationally associated with the at least one guide-way 415, with the at least one rack defining a linear arrangement of teeth 430. The guide-way preferably comprises at least one slot 416 defined in the housing 410 and a shelf 417 defined proximal to the housing's top edge 418. An abutment 421 is defined along the housings top edge and is configured to abut the at least one 425 rack along its top surface 419. The at least one slot 416 is configured to both accept a male insertion of the rack there-through and maintain the rack along the shelf 417.

A pinion assembly 435 defining a circular arrangement of teeth 440 is configured for meshing engagement with the linear arrangement of teeth 430 of the at least one rack 425. The circular arrangement of teeth 440 is operably biased to a locked position "A" from a rotatable position "B" (FIG. 8), such that the rack 425 is prevented from translating in relation to the housing 410 when the circular arrangement of teeth is in the locked position and allowed to translate when the circular arrangement of teeth is in the rotatable position. The pinion assembly 435 further defines an outer end 445 configured for insertional engagement with an orifice 50 (FIG. 2) defined in the apparel 20.

A distal end 455 of the at least one rack 425 is configured for fixable engagement with the material of the apparel 20. In the embodiment illustrated in FIGS. 1 and 2, the distal end 455 of the at least one rack 425 defines a planar flange 460 having a void 465 defined there-through. The planar flange 460 is sheet-like in structure to allow for a non-interfering and operable relation of the rack 425 with the sheet-form material typically comprising apparel 20. In this embodiment, the void 465 defines a through rectangular opening such that a portion or flap of the tensioning webbing 81 of the apparel 20 may be inserted through the void and sewn to the apparel adjacent thereto. However, a rivet or similar fastener (not shown) may also be inserted through the rack's void 465 and adjacent material of the apparel 20 to securely fasten the rack to the apparel. In other embodiments, however, the flange 460 of the at least one rack 425 may be sewn to adjacent material of the apparel 20 as well.

As illustrated in FIG. 7, the apparel 20, for example, comprises a pair of pants 70, with the fastener 5 incorporated into the pant's waistline 75 to replace a standard button (not shown). As is typical within the industry, the pants 70 includes a hollow loop of material at its waistline to create at least two "front-to-back" layers 77 and 78 of material encircling the waistline to increase its strength and durability. To more clearly illustrate the placement of the fastener 5 in relation to the pants 70, FIG. 7 illustrates a rectangular section of the front material 77 lifted upwardly and away from the rear material 78 along a seam 79 such that the apparatus is proximal to the rear material and the front material is folded downwardly along the seam to a location proximal to and in front of the apparatus. The fastener's housing 410, at least one guide-way 415 and at least one rack 425 are together sewn into the pant's waistline 75, preferably between the front and back material layers 77 and 78, with the fastener's pinion assembly 435 protruding outwardly through an opening 80, defined through the front layer, to function as the standard button for insertion through the apparel's orifice 50.

The rack 425 and housing 410 are preferably comprised of flexible, lightweight, and corrosion-free sheet-form materials of high durability. The flexible and lightweight traits of the material allow the components to assume the bodily contours of a wearer of the apparel utilizing the fastener, all while adding negligible weight to the apparel itself. The material of the rack and/or housing may be produced or manufactured to possess a predetermined curvature to further ensure a proper of the apparatus to the contours of a body. The durable and corrosion free traits of the material allows for the regular wear and laundering of the apparel utilizing the fastener without risk of the fastener staining the apparel or otherwise breaking. As such, at least the housing and rack preferably comprise sheet-form plastic or aluminum. The thickness of the sheet-form material comprising the housing 10 is between about 0.039 and 0.393 inches, preferably between about 0.079 and 0.197 inches, and optimally about 0.177 inches. Similarly, the thickness of the sheet-form material comprising the rack 25 is between about 0.016 and 0.393 inches, preferably between about 0.023 and 0.197 inches, and optimally about 0.393 inches. The sheet-form materials for the housing 10 and/or rack 25 may be stamped from a sheet-form material source, made from an injection molded process, machined or manufactured by other means understood in the art.

Figure 9:
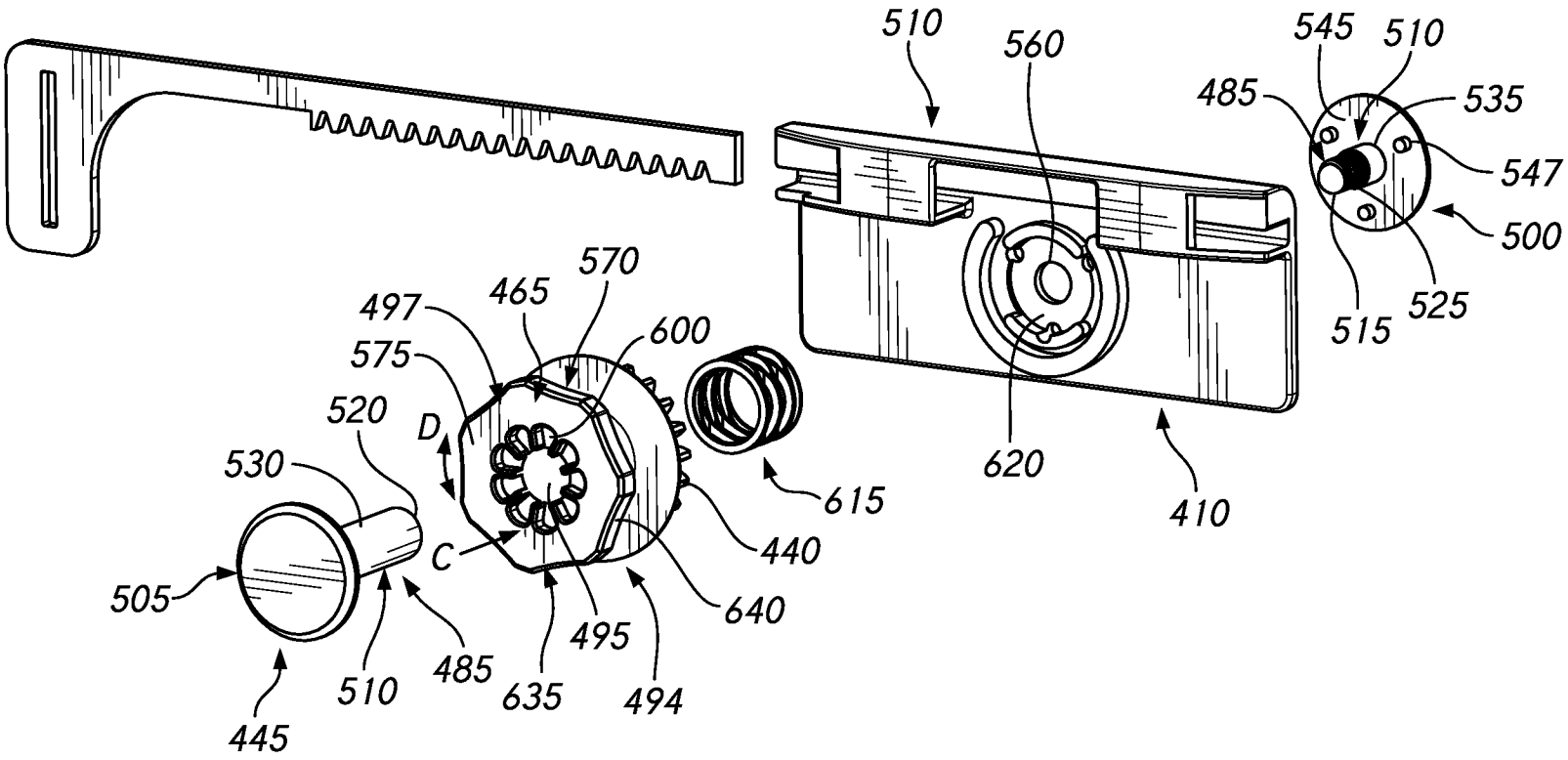
FIG. 9 is an exploded view of the fastener of FIG. 6 illustrating the details of a mating engagement within the pinion assembly.

Referring now to FIGS. 8 and 9, the pinion assembly 435 further defines a shaft 485 affixed to the housing 410 and terminating outwardly of the housing at the pinion assembly's outer end 445. The circular arrangement of teeth 440 extends radially from a disc 490 defined at an inner end 492 of a longitudinal pedestal 494, with the pedestal 494 and disc 490 having an axial bore 495 defined there-through. The shaft 485 extends through the axial bore 495 of the pedestal 494 and disc 490, both of which are configured for both rotational and lateral movement about the shaft 485. The pedestal 494 further defines an outer face 575 at an outer end 497 thereof, each of which has the axial bore 495 defined there-through. The pedestal 494 is rotatable about the shaft 485 and laterally biased outwardly such that its outer end 497 non-rotatably engages the outer end 445 of the pinion assembly to define the aforementioned locked position A.

Figure 10:
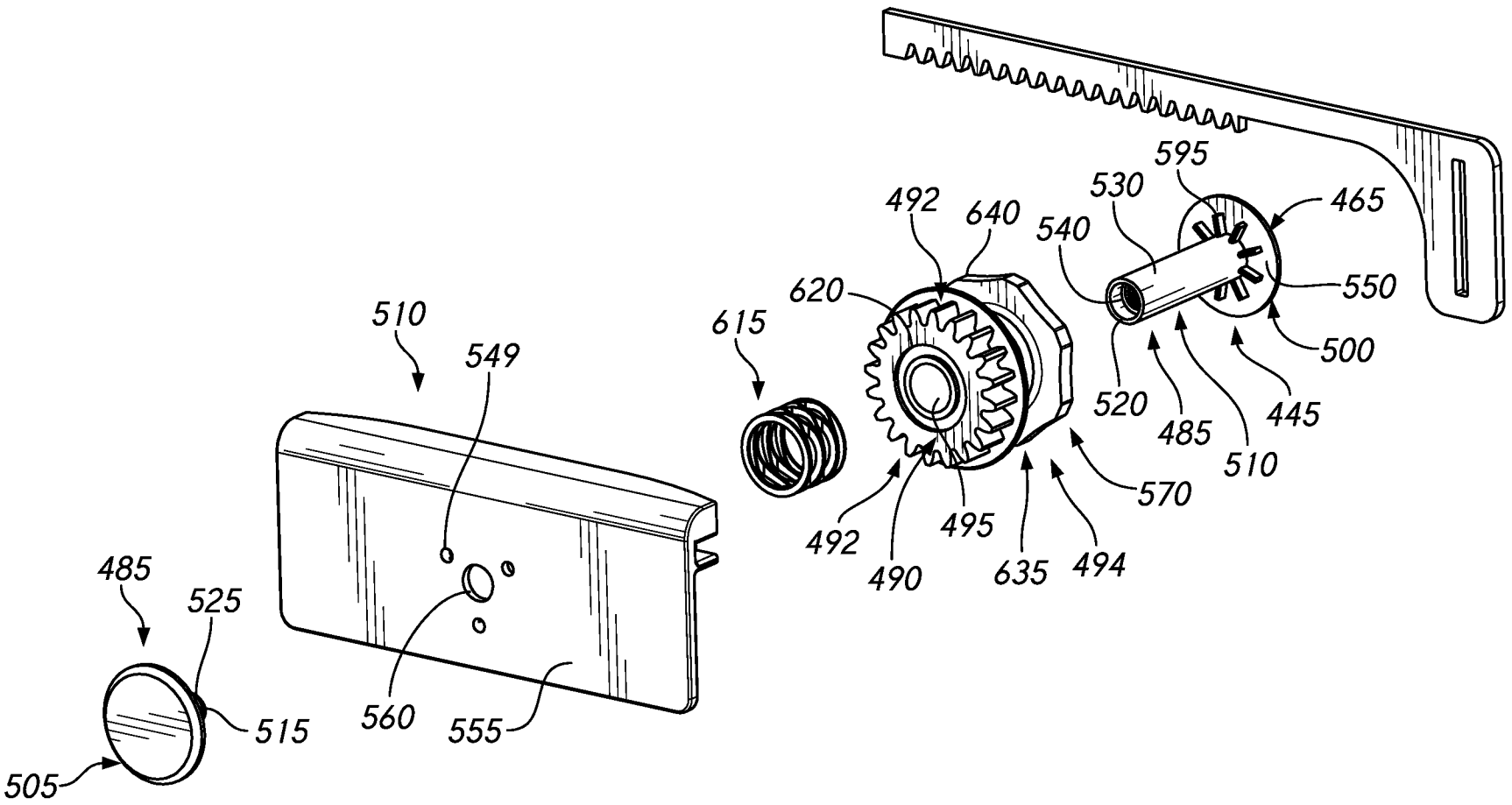
FIG. 10 is an exploded view of the spring of the housing along with the disc and grip of the pinion assembly of FIG. 6.

As best illustrated in FIGS. 9 and 10, the shaft 485 comprises opposing column ends 500 and 505 defined opposite of one another to define a central column 510, with each column end approximating the shape of a rivet head. The opposing column ends 500 and 505, in turn, each define inner mating ends 515 and 520, and associated column portions 525 and 530 which, when in mating relation with one another, define the central column 510. The mating ends 515 and 520 thus preferably define respective, male and female threaded components 535 and 540 that threadedly engage one another to define the column 510. Although a threaded connection is described and illustrated herein at mating ends 515 and 520, it is understood that other connections may be utilized as well, to include pinned male-female connections, press-fit and other connections understood in the art as preventing a rotation and translation of components relative to one another.

Referring again to FIGS. 9 and 10, the opposing column ends 400 and 505 each define a planar inner face 545 and 550. Planar inner face 545 is affixed to a planar rear surface 555 of the housing 510 such that column portion 525 extends forwardly through a hole 560 defined through the housing for threaded engagement with opposing column portion 530. Such affixation may comprise spot welding, thermal bonding, brazing, adhesive bonding or other bonding methods understood in the art. The affixation of the inner face 545 of the column end 500 to the rear surface 555 of the housing 510 prevents the column end and associated portion 525 from rotating in relation to the housing and also from translating outwardly from the housing's rear surface 555. The threaded engagement of the opposing column portion 525 and end mating end 515 to opposing portion 530 thus similarly affixes them as well in relation to the housing 510. At least one pin 547 is defined on the inner face 545 of the inner column end 500 for mating engagement with at least one receiver 549 defined in the housing 510. Thus, if the threaded engagement of the column portions 525 and 530 affixes them to the housing 510, the engagement of the at least one pin 547 with the receiver 549 prevents at least the inner column end 500 from rotating in relation to the housing.

The non-rotatable engagement of the pedestal 494 to the outer end 445 of the pinion assembly 435 preferably comprises a mating obstruction 465 defined there-between. More specifically, as illustrated herein, the pedestal outer face 575 configured for mating engagement with the inner face 150 of column end 105. Referring again to FIGS. 9 and 10, a plurality of radial spokes 595 protrude from the inner face 550 of outer column end 505 for mating engagement with a plurality of radial recesses 600 defined in the pedestal outer face 575. The mating engagement of the spokes 595 with the recesses 600 prevents the pedestal 494 from rotating in relation to the outer end 445 of the pinion assembly 435, but nonetheless allows the pedestal to move laterally and inwardly from the end and along the shaft 485. The components of the pinion assembly 435, together or independently, may be comprised of durable materials, to include aluminum, steel, plastics, combinations or other materials understood in the art as providing the desired durability.

The lateral outwardly bias of the pedestal 494 along the shaft 485 to a non-rotatable engagement with the inner face 550 of the column end 505 comprises a spring 615 that forcibly contacts an inner face 620 of the pedestal defined at its inner end 492. Referring to FIG. 10, in a preferred embodiment, the spring 615 comprises a circular leaf spring located between the housing 510 and pedestal inner surface 492 about housing's hole 560 and configured for resilient engagement with an inner face 620 of the pedestal defined at its inner end. In other embodiments, however, a common coil spring (not shown) may be utilized in place of the circular leaf spring. In further embodiments, the spring 615 comprises a plurality of forwardly directed tabs (FIGS. 4-5) defined in the housing 510 about housing's hole 560 and configured for resilient engagement with the inner face 620 of the pedestal 494.

Referring again to FIGS. 8 and 10, a grip 570 is thus configured to transmit a lateral force "C" to the pedestal 494 to both overcome the bias of the spring 615 and move the pedestal laterally along the shaft 485 of the pinion assembly 435 to the rotatable position B from the locked position A, and also configured to transmit a rotational force "D" to the pedestal to rotate the pedestal (when not in the locked position), to rotate the disc's 490 circular arrangement of teeth 440 of the pedestal 575 against rack 425. More specifically, the lateral force C urges the pedestal's inner face 620 against the spring 615 such that the spring is compressed rearwardly against the housing's inner wall 620.

During this movement, the teeth 440 of the pedestal's disc 490 remain engaged with the at least one rack 425, but translate rearwardly in relation to the rack's teeth 430 and towards the housing's inner wall 620. During this rearward movement, the pedestal is translated rearwardly along the column 510 to disengage the pedestal's recesses 600 from the spokes 595 of the outer column end 505. With the spokes and recesses disengaged from one another, the pedestal is rotatable about the column 110 via the application of rotatable force D (FIG. 10). Of course, during any rotation of the pedestal 494, the rack 425 will translate in relation to the housing 510, and apply a like translational force against the material of the apparel 20 affixed to the rack's planar flange 460.

To facilitate the transmission of both the lateral and rotational forces C and D to the pedestal 494, the grip 570 defines a diameter larger than that of the column end 505 such that the outer face 575 of the pedestal and an associated peripheral edge 635 are exposed beyond that of the column end to a facilitate tactile contact with the fingers and thumb of a user of the fastener 5. In a preferred embodiment, the peripheral edge 635 of the grip 570 is also textured to improve such tactile contact as well. For example, in the embodiments illustrated herein, the peripheral edge 635 of the grip 570 defines a plurality of truncated ridges 640. However other textures may suffice as well, to include cross-hatch, dimpled and other patterns understood in the art of increasing tactile friction. Nonetheless, despite the larger diameter of the grip 570, the diameter is nonetheless configured for insertional engagement with the standard orifice 50 defined in the apparel 20. Thus, the diameter of the grip is between about 0.375 and 2.0 inches, preferably between about 0.5 and 1.5 inches, and optimally about 0.875 inches.

In use in the first embodiment, a fastener is provided with a piece of apparel worn by an individual, the fastener comprising a housing defining at least one guide-way, at least one rack connectible with the apparel and translationally associated with the at least one guide-way, the rack defining a linear arrangement of teeth and a pinion assembly operably associated with the housing and defining a circular arrangement of teeth configured for operable engagement with the linear arrangement of teeth of the rack, the circular arrangement of teeth operably biased to a locked position from a rotatable position, the pinion assembly further defining an outer end configured for insertional engagement with an orifice defined in the apparel.

The outer end of the pinion assembly of the fastener is inserted through the orifice defined in the apparel. A grip of the pinion assembly is gripped, and a translational force is exerted on the grip to translate the disc to a rotatable position from a biased, non-rotatable position. A rotational force is exerted on the grip to rotate the disc and translate an operably associated rack affixed to the apparel from a locked position. At least the translational force is thereafter removed from the grip, allowing the disc to translate in an opposite direction to the biased, non-rotatable position to secure the rack in the locked position.

In use in the second embodiment, a fastener is provided with a piece of apparel worn by an individual, the fastener comprising a housing defining at least one guide-way, at least one rack connectible with the apparel and translationally associated with the at least one guide-way, the rack defining a linear arrangement of teeth and a pinion assembly operably associated with the housing and defining a circular arrangement of teeth configured for operable engagement with the linear arrangement of teeth of the rack, the circular arrangement of teeth operably biased to a locked position from a rotatable position, the pinion assembly further defining an outer end configured for insertional engagement with an orifice defined in the apparel.

The outer end of the pinion assembly of the fastener is inserted through the orifice defined in the apparel. A grip of the pinion assembly is gripped, and a translational force is exerted on the grip to translate the pedestal to a rotatable position from a biased, non-rotatable position. A rotational force is exerted on the grip to rotate the pedestal and translate an operably associated rack affixed to the apparel from a locked position. At least the translational force is thereafter removed from the grip, allowing the pedestal to translate in an opposite direction to the biased, non-rotatable position to secure the rack in the locked position.

While this foregoing description and accompanying figures are illustrative of the present invention, other variations in structure and method are possible without departing from the invention's spirit and scope.

We claim:

1. A fastener for apparel comprising:

a housing defining at least one guide-way;

at least one rack connectible with the apparel and translationally associated with the at least one guide-way, the rack defining a linear arrangement of teeth;

a pinion assembly defining a circular arrangement of teeth configured for operable engagement with the linear arrangement of teeth of the rack, the pinion assembly translationally biased to a locked position from a rotatable position, the pinion assembly further defining an outer end configured for insertional engagement with an orifice defined in the apparel;

wherein the pinion assembly further defines a shaft affixed to the housing and terminating outwardly of the housing at the outer end of the assembly, said circular arrangement of teeth extending radially from a disc having an axial bore defined there-through, the shaft extending through the axial bore of the disc, the disc rotatable about the shaft and laterally biased to non-rotatably engage the outer end of the assembly to define the locked position;

wherein the non-rotatable ent of the disc to the outer end comprises a mating obstruction defined there and the bias of the disc to the non-rotatable engagement comprises a spring forcibly contacting the disc;

the fastener further comprising a grip located between the disc and outer end and defining the mating obstruction there-between, the grip configured to transmit a lateral force to the disc to overcome the bias of the spring and also configured to transmit a rotational force to the disc to rotate the disc when not in the locked position, the grip is further configured for insertional engagement with the orifice;

and wherein the spring comprises a plurality of inwardly directed tabs defined in the housing about the shaft, the tabs configured for resilient engagement with an inner face of the disc.

2. A fastener for apparel comprising:

a housing defining at least one guide-way;

at least one rack connectible with the apparel and translationally associated with the at least one guide-way, the rack defining a linear arrangement of teeth;

a pinion assembly defining a circular arrangement of teeth configured for operable engagement with the linear arrangement of teeth of the rack, the pinion assembly translationally biased to a locked position from a rotatable position, the pinion assembly further defining an outer end configured for insertional engagement with an orifice defined in the apparel;

wherein the pinion assembly further defines a shaft affixed to the housing and terminating outwardly of the housing at the outer end of the assembly, said circular arrangement of teeth extending radially from a disc having an axial bore defined there-through, the shaft extending through the axial bore of the disc the disc rotatable about the shaft and laterally biased to non-rotatably engage the outer end of the assembly to define the locked position, wherein the non-rotatable engagement of the disc to the outer end comprises a mating obstruction defined there-between and the bias of the disc to the non-rotatable engagement comprises a spring forcibly contacting the disc; and the fastener further comprising a grip located between the disc and outer end and defining the mating obstruction there-between, the grip configured to transmit a lateral force to the disc to overcome the bias of the spring and also configured to transmit a rotational force to the disc to rotate the disc when not in the locked position, the grip is further configured for insertional engagement with the orifice, wherein the mating obstruction comprises a plurality of radial spokes protruding from an inner face defined at the outer end and configured for mating engagement with a plurality of radial recesses defined in an outer face of the grip.

3. The fastener of claim 2 wherein the rack defines a distal end connectable with the apparel.

4. The fastener of claim 3 wherein the distal end of the rack defines a through orifice.

5. The fastener of claim 4 further comprising a webbing extending through the orifice and connectable with the apparel.

6. A fastener for apparel comprising:

a housing defining at least one guide-way;

at least one rack connectible with the apparel and translationally associated with the at least one guide-way the rack defining a linear arrangement of teeth;

a pinion assembly defining a circular arrangement of teeth configured for operable engagement with the linear arrangement of teeth of the rack, the pinion assembly translationally biased to a locked position from a rotatable position, the pinion assembly further defining an outer end configured for insertional engagement with an orifice defined in the apparel, wherein the pinion assembly further defines a shaft affixed to the housing and terminating outwardly of the housing at the outer end of the assembly, said circular arrangement of teeth extending radially from a pedestal having an axial bore defined there-through, the shaft extending through the axial bore of the pedestal, the pedestal rotatable about the shaft and laterally biased to non-rotatably engage the outer end of the assembly to define the locked position; and wherein the non-rotatable engagement of the pedestal to the outer end comprises a mating obstruction defined there-between and the bias of the pedestal to the non-rotatable engagement comprises a spring forcibly contacting the pedestal.

7. The fastener of claim 6 further comprising a grip defined on the pedestal proximal to the outer end and defining the mating obstruction there-between, the grip configured to transmit a lateral force to the pedestal to overcome the bias of the spring and also configured to transmit a rotational force to the pedestal to rotate the pedestal when not in the locked position, the pedestal further configured for insertional engagement with the orifice.

8. The fastener of claim 7 wherein the spring is located about the shaft between the pedestal and the housing.

9. The fastener of claim 6 wherein the mating obstruction comprises a plurality of radial spokes protruding from an inner face of defined at the outer end and configured for mating engagement with a plurality of radial recesses defined in an outer face of the pedestal.

* * * * *